United States Patent [19]

Ikenishi et al.

[11] 4,274,150

[45] Jun. 16, 1981

[54] ELECTRONIC WATCH

[75] Inventors: Masataka Ikenishi; Joichi Miyazaki; Shozo Kushida; Hiromasa Nakanishi; Makoto Ueda; Masaharu Shida, all of Tokyo, Japan

[73] Assignee: Kabushiki Kaisha Daini Seikosha, Tokyo, Japan

[21] Appl. No.: 919,611

[22] Filed: Jun. 27, 1978

[30] Foreign Application Priority Data

Jun. 28, 1977 [JP] Japan ..... 52/77314

[51] Int. Cl.[3] ..... G04B 17/12

[52] U.S. Cl. ..... 368/185; 368/228; 368/187; 368/76

[58] Field of Search ..... 58/23 R, 85.5, 23 D; 368/185, 187, 228, 76

[56] References Cited

U.S. PATENT DOCUMENTS

| | | | |
|---|---|---|---|
| 3,948,036 | 4/1976 | Morokawa | 58/85.5 X |
| 3,967,442 | 7/1976 | Berney | 58/85.5 X |
| 4,022,013 | 5/1977 | Kamijo | 58/85.5 X |
| 4,050,234 | 9/1977 | Toshio | 58/85.5 |
| 4,051,666 | 10/1977 | Yoshino et al. | 58/85.5 |

*Primary Examiner*—Ulysses Weldon

*Attorney, Agent, or Firm*—Robert E. Burns; Emmanuel J. Lobato; Bruce L. Adams

[57] ABSTRACT

An electronic timepiece having a stepping motor and a drive circuit responsive to a control signal for applying electrical drive pulses having polarities determined by the control signal for rotating the rotor of the stepping motor. The control circuit normally operates in a mode for applying a control signal to the drive circuit effective to control the drive circuit to apply alternate polarity electrical drive pulses to rotate the stepping motor rotor in a normal direction. Resetting circuitry is operable for correcting the time kept by the timepiece. A detecting circuit detects whether the stepping motor rotor is in a position to be rotated by a forthcoming drive pulse after resetting. If the stepping motor rotor is not in a position for rotation a detection circuit signal is applied to the control circuit so that the control signal controls the drive circuit to apply an electrical pulse effective to rotate the stepping motor rotor after resetting. Consequently, after resetting the immediately forthcoming drive pulse will have a polarity effective to rotate the stepping motor rotor and no time will be lost.

5 Claims, 14 Drawing Figures

ELECTRONIC WATCH

The present invention relates to an electronic watch, in particular, to an electronic watch which comprises pointers carried out pendulum moving by a stepping motor and displays the time in analog mode.

The circuit of the conventional electronic watch having a display device which displays the time by pointers driven by a stepping motor is generally constructed as shown in FIG. 1. The original signal produced by a oscillating circuit, for example, which frequency is 32,768 Hz, is converted into a reference pulse signal, which has the pulse width of 7.8 msec and the period of one second and is used as a time base, by a frequency dividing circuit 2 consisting of a plurality of frequency dividing stages and wave forming circuit 3. The reference pulse signal is applied to a driving circuit 4 including inverters 5 and 6. The driving circuit 4 has a circuit which develops signals Pa and Pb having the same pulse width of 7.8 msec and the same pulse period of 2 sec but out of phase by one second relative to each other with reference to the reference pulse BP. These pulses Pa and Pb are applied to the input terminals of the inverters 5 and 6. Therefore, between the output terminals of the inverters 5 and 6, a driving pulse DP which changes it's polarity every one second is produced. By this driving pulse DP, a current which changes in direction every one second flows through the a coil 7 of the stepping motor. The stepping motor has a rotor constructed by a permanent magnet and the rotor has two or six poles. By applying the driving pulse changing its polarity alternatingly to the coil of the stator, the rotor rotates intermittently in the predetermined direction with a step of 180° in the case of the rotor having two poles, and rotates with a step of 60° in the case of the rotor having six poles.

FIG. 3 shows a part of a display device of a conventional analogue type electronic watch. In this display device, there is provided an adjusting lever 14 which is located against a second wheel (fourth wheel) 12 engaged with a rotor pinion 11 of a rotor 10 of a stepping motor and is operated together with the operation of a control pin 13. The adjusting lever 14 has a switching function for a reset circuit 8 shown in FIG. 1, a part of the lever is used as a contact corresponding to a contact 15. When the control pin 13 is manipulated for correcting the time displayed by the watch, the adjusting lever 14 moves from the position shown by the dotted line to the position shown by the full line to contact the second wheel 12, and the rotation of the second wheel 12 is stopped. Since the adjusting lever 14 contacts the contact 15 at the same time, a reset pulse is produced from the reset circuit 8, and the frequency dividing circuit 2 is reset. When the reset timing is coincident with the timing for producing a reference pulse BP, the adjusting lever 14 prevents the second wheel from rotating, as a result, the rotor 10 can not be rotated in spite of applying the driving pulse DP to the coil 7. In this case, since the polarity of the driving pulse DP relative to the first reference pulse BP, after releasing the reset condition, becomes opposite in polarity relative to the polarity for rotating the rotor 10, the stepping motor 9 can not be operated for one pulse of the reference pulse signal BP, and as a result, the time indication of a second pointer loses one second.

The adjusting device of the second wheel shown in FIG. 3 has a construction which stops the second wheel at the time location to be set. However, in the prior art, there is a construction, wherein, when the reset operation is made, the second pointer is moved to twelve oclock position in a moment by using a heart cam, and is stopped. In this case, even when the reset timing is not coincident with the timing for producing a reference pulse PB, the polarity of the driving pulse DP responding to the first shot of the reference pulse BP after releasing the reset condition sometimes becomes opposite in polarity relative to the polarity for rotating the rotor 10. In this case, the indication time also loses one second. In order to solve this problem, it is important to prevent the stepping motor 9 from being in an inoperative condition by determining the polarity of the driving pulse at the first shot after releasing the reset condition, by utilizing the fact that the position of the rotor 10 is always in a constant position when the second pointer is stopping in the twelve oclock position. However, in this case, when assembling the watch, if the magnetic poles direction of the rotor 10 is not set in the predetermined direction, after releasing the reset condition the position and time indication of the second pointer surely loses one second. Moreover, when the adjusting device is added in which the second pointer is moved to the predetermined positions such as position of ten seconds, twenty seconds, or thirty seconds, in addition to the position of twelve oclock, and is stopped, it is substantially meaningless to adopt the feature wherein the polarity of the driving pulse DP after releasing the reset condition has a predetermined polarity.

DESCRIPTION OF THE PREFERRED EMBODIMENT

The present invention provides an electronic watch which comprises a detecting means for detecting electrically the rotor position at the time when the reset condition has just been released. By automatically controlling the polarity of the driving pulse on the basis of the result of the detection, the problem wherein the stepping motor can not respond to the above-mentioned first shot of the reference pulse after releasing the reset condition can be solved, even when the adjusting device which moves the second pointer to the predetermined time position at the operation of the reset stops the pointer.

The present invention will be explained with reference to the illustrated embodiment, hereinafter.

Figure 1:
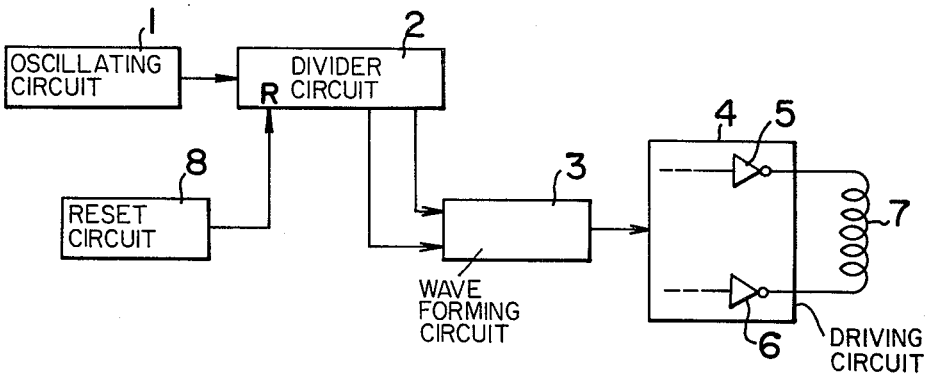
FIG. 1 PRIOR ART
FIG. 1 shows a circuit construction of a general analog type electronic watch.
Figure 2:
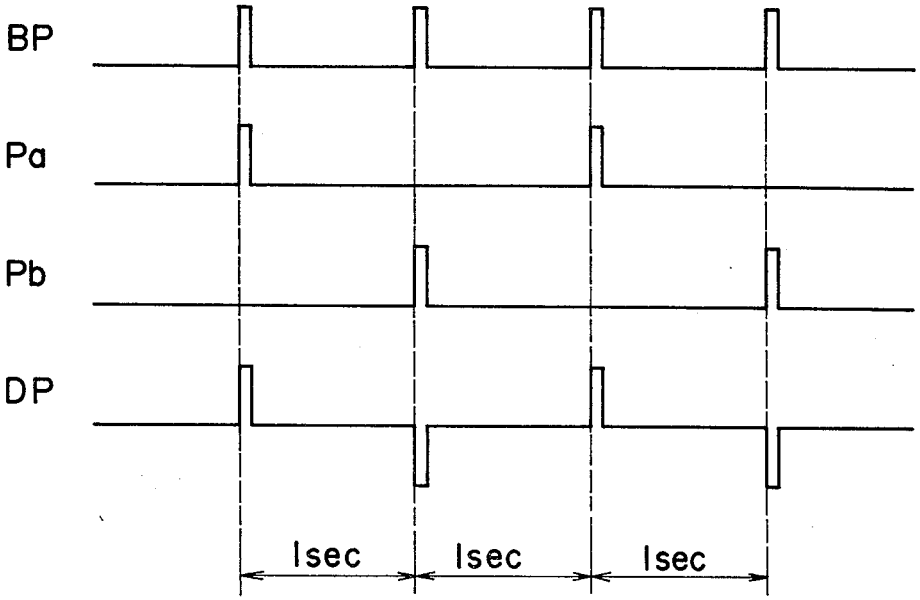
FIG. 2 PRIOR ART
FIG. 2 shows a time chart, wherein, pulse waveforms produced at each portion of the circuit shown in in the FIG. 1 is shown.
Figure 3:
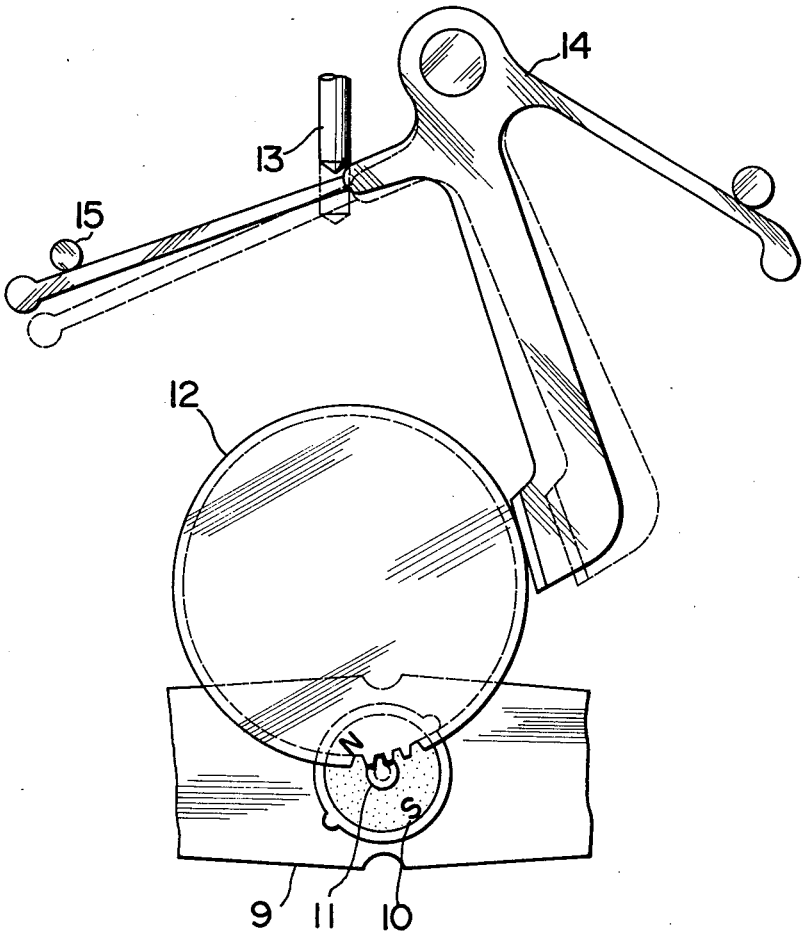
FIG. 3 PRIOR ART
FIG. 3 shows a schematic drawing of an adjusting device for the second pointer in the conventional electronic watch.
Figure 4:
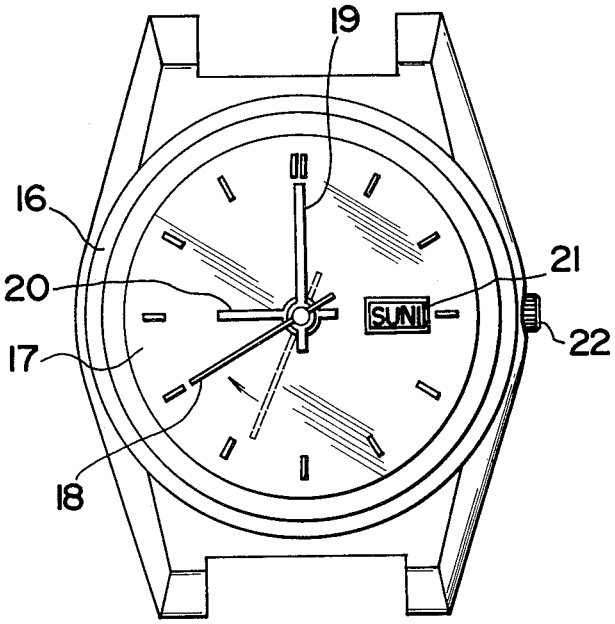
FIG. 4 shows a plan view of an electronic watch according to the present invention.

FIG. 4 shows the front view of an analogue type electronic watch according to the present invention, and the watch has a casing 16, a dial 17, a second pointer 18, a minutes pointer 19, an hour pointer 20, a calender display plate 21, and an adjusting stem 22.

Figure 5:
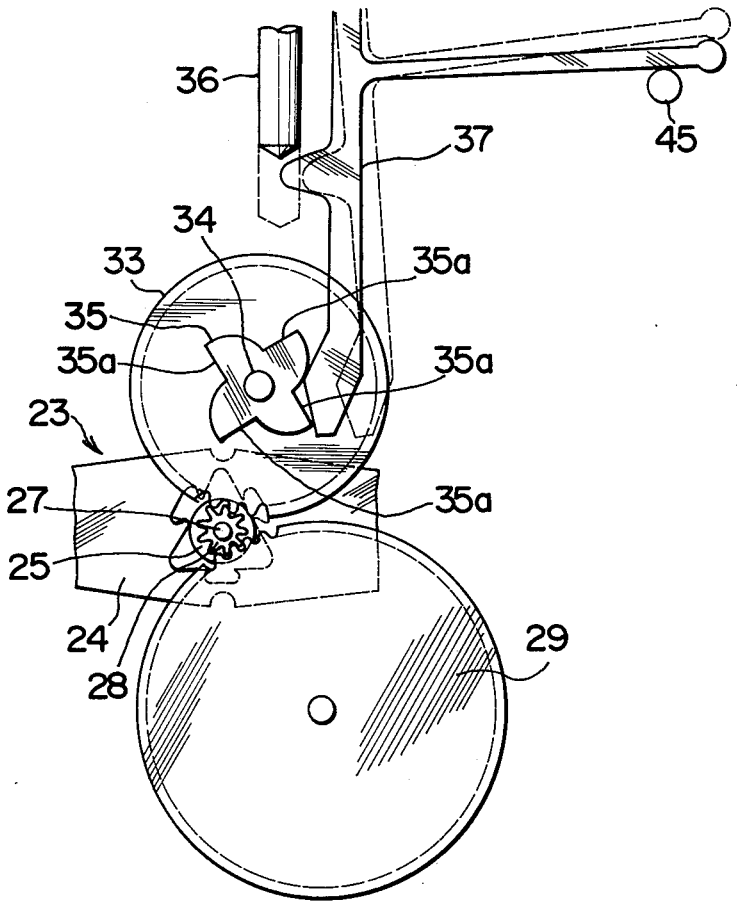
FIG. 5 is a drawing of a part of the inner construction of the electronic watch shown in FIG. 4.
Figure 6:
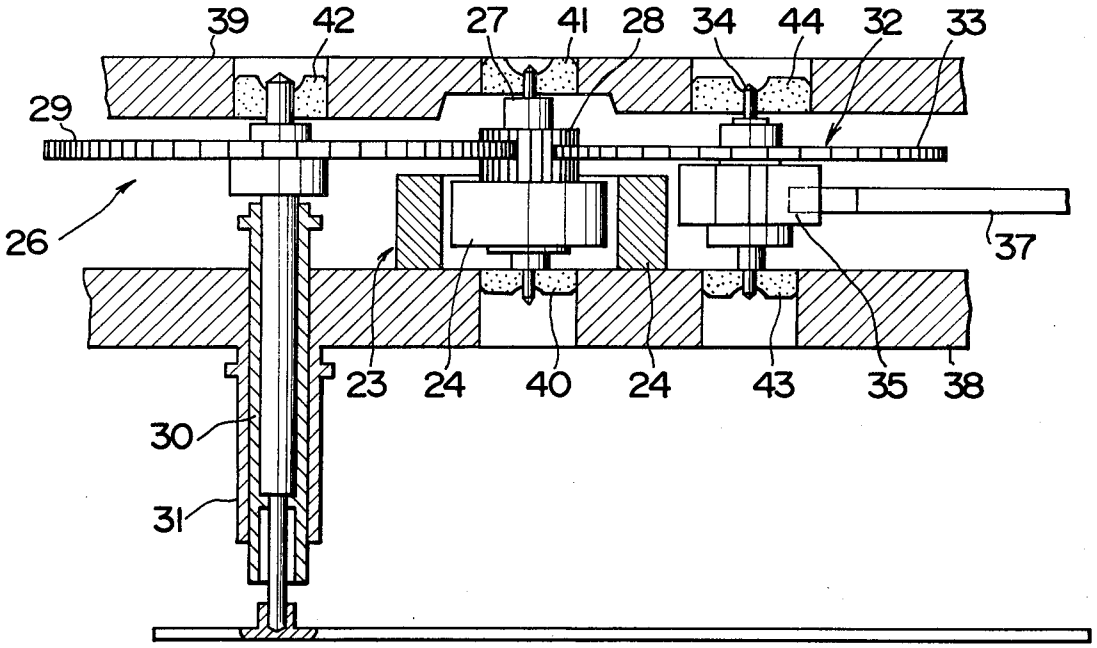
FIG. 6 shows a vertical sectional view of the watch shown in FIG. 4.

FIGS. 5 and 6 show a part of the inner construction of such electronic watch.

The reference numeral 23 indicates a stepping motor consisting of a stator 24 having a coil (not shown) and a rotor 25 made of a permanent magnet, the reference numeral 26 indicates a display device comprising a second wheel (fourth wheel) 29 engaging with the rotor pinion 28 of the rotor shaft 27, a cylindrical pinion 30 and a cylindrical wheel 31. The reference numeral 32 indicates an adjusting device comprising an adjusting wheel 33 engaged with the rotor pinion 28, a cam 35 rotating together with a shaft 34 of the adjusting wheel 33, and an adjusting lever 37 moving with a control pin 36 operated by adjusting stem 22.

The reference numeral 38 indicates a base plate, 39 indicates bridge plate, 40 and 41 indicate support bearings of the rotor shaft 27, 42 indicates support bearings of the shaft of the second wheel 29, and 43 and 44 indicate support bearings of the shaft 34.

The rotor 25 of the stepping motor 23 according to the embodiment is magnetized in six poles, and rotates in the predetermined direction with a step of 60° in response to driving pulses which change polarity alternatingly. The ratio of the number of teeth of rotor pinion 28 to the number of teeth of the second wheel 29 is 6:60, so that when the stepping motor is rotated with a rotation speed of one revolution per second, the rotor pinion 28 rotates by 1/6 revolution per second and the second wheel rotates by 1/60 revolution per second.

The cam 35 has four stepped portions 35*a*. When the adjusting lever 37 moves from the normal position shown by the dotted line to the contact position shown by the full line by operating the control pin 36, the cam 35 rotates to a stable position which is determined by one of the stepped portions 35*a* of the cam. Namely, in this embodiment, the cam 35 moves to the four stable positions and is stopped by contact of the adjusting lever 37 at the stable positions. Since the ratio of the number of teeth of adjusting wheel 33 rotating together with the cam 35 to the number of teeth of rotor pinion 28 is selected to be 40:6, when the cam 35 rotates from one stable position to the next stable position, the rotor pinion 28 rotates by 10/6 revolutions, whereby the second wheel 29 rotates by 1/6 revolution. Therefore, the second wheel 29 moves to the predetermined position with a step of 1/6 revolution by the adjusting device 32 and stops at the position. This means that the second pointer 18 is moved between points spaced by ten seconds by the adjusting device 32 and is stopped at these points. For example, as shown in FIG. 4, when the reset operation is made at the time when the second pointer 18 is beyond the thirty second position as shown by the dotted line, the second pointer is moved to the indicated forty second position shown by the full line and is stopped. The adjusting lever 37 is made of a conductive metal, a part of the lever functions as a contact of a switch 50 of a reset circuit 49 shown in FIG. 7. This lever 37 comes in contact with a contact 45 when the lever 37 is moved to the position shown by full line, by operating the control pin 36.

Next, the circuit construction of an electronic watch according to the present invention will be explained with reference to the embodiment shown in FIG. 7.

Figure 7:
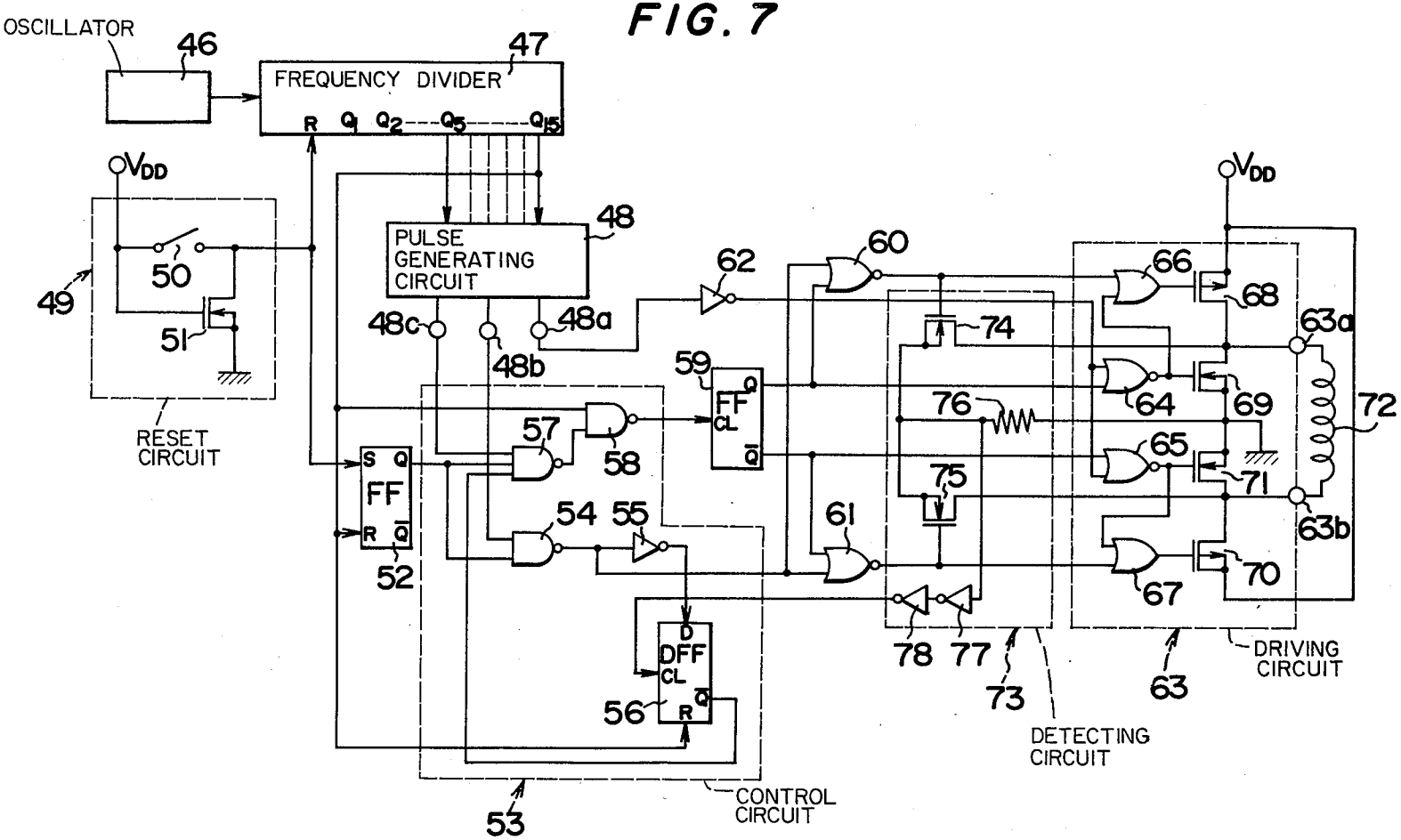
FIG. 7 shows a circuit diagram of the electronic watch according to the present invention.

In FIG. 7, reference numeral 46 indicates a oscillating circuit which generates an oscillatory signal of 32,768 Hz and 47 represents a frequency dividing circuit which is constructed by connecting fifteen ½ frequency dividing stages in series. 48 represents a pulse generating circuit to which the frequency dividing output $Q_5$ of the fifth stage of the frequency dividing circuit 47 through the frequency dividing output $Q_{15}$ of the fifteenth stage are applied and this circuit 48 has three output terminals 48*a*, 48*b* and 48*c*. From the output terminal 48*a* a reference pulse $\phi a$ is delivered, from the output terminal 48*b* a detection pulse $\phi b$ is delivered, and from the output terminal 48*c* a reversing pulse $\phi c$ is delivered. Each of the pulses $\phi a$, $\phi b$ and $\phi c$ are expressed by the following logical expression.

$$\phi a = Q_9 \cdot Q_{10} \cdot Q_{11} \cdot Q_{12} \cdot Q_{13} \cdot Q_{14} \cdot Q_{15}$$

$$\phi b = Q_5 \cdot Q_6 \cdot Q_7 \cdot \overline{Q}_8 \cdot \overline{Q}_9 \cdot \overline{Q}_{10} \cdot \overline{Q}_{11} \cdot \overline{Q}_{12} \cdot \overline{Q}_{13} \cdot \overline{Q}_{15}$$

$$\phi c = Q_9 \cdot Q_{10} \cdot \overline{Q}_{11} \cdot \overline{Q}_{12} \cdot \overline{Q}_{13} \cdot \overline{Q}_{14} \cdot \overline{Q}_{15}$$

Figure 8:
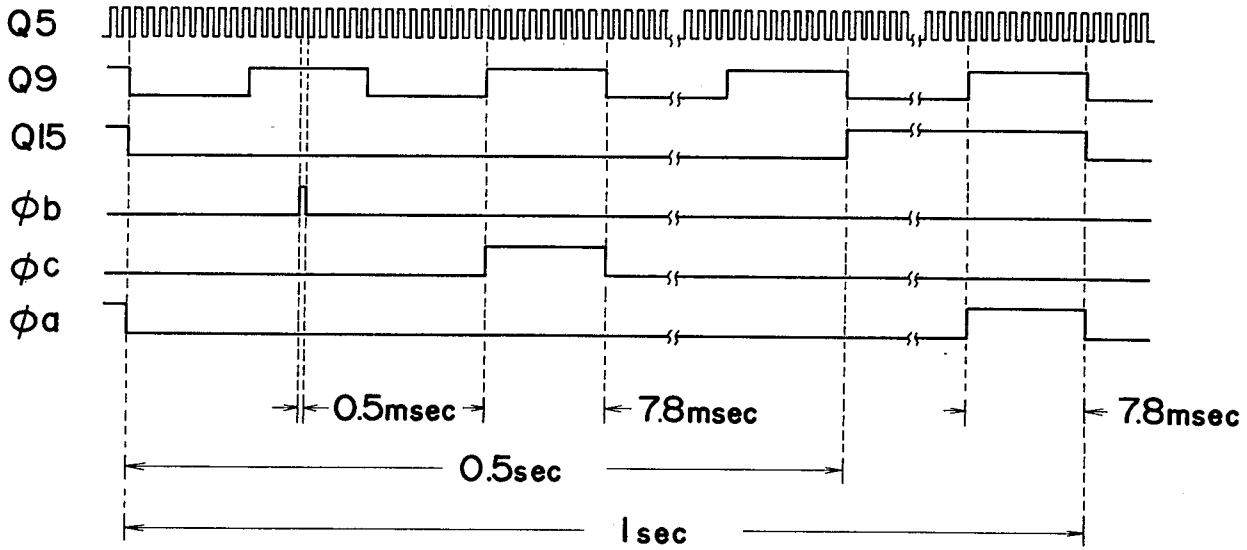
FIG. 8 shows a timing chart of each of the pulses delivered from the frequency dividing circuit and the pulse generating circuit in FIG. 7, FIGS. 9 and 10 show operations of the stepping motor.

In FIG. 8, waveforms of frequency divider outputs $Q_5$, $Q_9$, $Q_{15}$, reference pulse $\phi a$, detection pulse $\phi b$ and reversing pulse $\phi c$ are shown.

Reference numeral 49 indicates a reset circuit which has a switch 50 composing of the above-mentioned adjusting lever 37 and the contact 45, and a N channel type MOS FET 51. The one contact of the switch 50 is connected to the power source terminal $V_{DD}$ at the high voltage side, the other contact of the switch 50 is connected to a reset terminal R of the frequency dividing circuit 47, the drain electrode of the MOS FET 51 and the set terminal S of a flip-flop circuit (which will be referred to as F.F). The gate of the MOS FET 51 is connected to the power source terminal $V_{DD}$, and the source is connected to the lower potential point or ground. Although the output of the reset circuit 49 is usually at the logic level of "0", when the switch is turned on, the output becomes "1" level. As a result of which, the frequency dividing circuit 47 is reset and each of the frequency divider 47 outputs $Q_1$ through $Q_{15}$ become "0" level, and at the same time the Q output of the F.F 52 is set at "1" level. The Q output of the F.F 52 is is normally kept at the "0" level by applying the frequency divider 47 output $Q_{15}$ to the reset terminal R in the normal condition.

Reference numeral 53 indicates a control circuit which has a NAND gate 54 to which the detection pulse $\phi b$ and Q output of the F.F 52 is applied, an inverter 55 for reversing the output of the NAND gate 54, D flip-flop (will be refered to as D F.F) 56 having a D terminal to which the output of the inverter 55 is applied, a NAND gate 57 to which the $\overline{Q}$ output of the D-F.F 56, the reversing pulse $\phi c$ and the Q output of the FF52 are applied, and a NAND gate 58 to which the output of the AND gate 57 and the output $Q_{15}$ of the frequency dividing 47 are applied. The output of the NAND gate 58 of the control circuit 53 is applied to the clock terminal CL of the flip-flop circuit 59 (will be refered to as FF) which operates as a converting circuit changing the polarity of a driving pulse, responding to the reference pulse $\phi a$ alternatingly. The Q output and $\overline{Q}$ output of the F.F59 are applied to NOR gates 60 and 61, and the detecting pulse $\phi b$ is applied through the NAND gate 54 and to NOR gates 60 and 61.

A driving circuit 63 comprises NOR gates 64 and 65 to which the reference pulse $\phi a$ inverted by inverter 62 is applied, and at the same time the Q output and $\overline{Q}$ output of the FF59 are applied to the NOR gates 64 and 65, respectively. The driving circuit also includes the OR gate 66 to which the outputs of NOR gates 60 and 64 are applied, an OR gate 67 to which the outputs of NOR gates 61 and 65 are applied, a P channel MOS FET (which will be refered to as P-MOS) 68 to the gate of which the output of OR gate 66 is applied, a N channel MOS FET (which will be refered to as N-MOS) 69 to the gate of which the output of the NOR gate 64 is applied, a P channel MOS FET (which will be refered to as P-MOS) 70 to the gate of which the output of the OR gate 67 is applied, and a N channel MOS FET (which will be refered to as N-MOS) 71 to the gate of which the output of the NOR gate 65 is applied. The output of the driving circuit 63 is obtained between the output terminal 63*a* which is connected to the drains of P-MOS 68 and N-MOS 69 and the output terminal 63*b* which is connected to the drains of P-MOS 70 and N-MOS 71. This output is applied to the coil 72 of a stepping motor. P-MOS 68 and N-MOS 69 as well as P-MOS 70 and N-MOS 71 are substantially operated as inverters. The sources of P-MOS 68, 70 are connected to the higher potential power source terminal $V_{DD}$, and the sources of N-MOSs 69, 71 are grounded to the lower potential point.

Reference numeral 73 indicates a detecting circuit for detecting the rotor position of the stepping motor. The detecting circuit 73 comprises N channel MOS FETs (which will be refered to as N-MOS) 74, 75 operating as switching elements, a resistor 76 acting as a detecting element for sensing the current value flowing through coil 72 in the form of dividing voltage to the voltage of power source. An inverter 77 constructed of C-MOS components operates as a binary logic circuit, and an inverter 78 inverts the output thereof. The drains of N-MOSs 74, 75 are connected to the output terminals and to the coil 72, and their sources are grounded through a resistor 76. The output of the NOR gate 60 is applied to the gate of N-MOS 74, and the output of NOR gate 61 is applied to the gate of N-MOS 75. The output of the inverter 78 is delivered as the output of the detecting circuit 73, and is applied to the clock terminal CL of D-FF 56 in the control circuit 53.

In the normal operating condition, since the Q output of the FF52 is kept at the "0" level, the output of NAND gates 54, 57 remain at the "1" level irrespective of the level values of detecting pulses $\phi b$ and reversing pulses $\phi c$. Therefore, the frequency dividing output Q15 having the same period as that of reference pulse $\phi a$ is applied to the clock terminal CL of FF59 through the NAND gate 58 so that the Q output and the $\overline{Q}$ output of the FF59 alternatingly becomes level "0" and level "1" every two seconds. Since the output of NAND gate 54 remains at the "1" level in the normal condition, the outputs of NOR gates 60 and 61 to which the output of FF59 is applied remain at the "0" level. As a result, N-MOSs 74 and 75 in the detecting circuit 73 are in the off condition. Therefore, in the normal condition, the detecting circuit 73 is inoperative. The outputs of OR gates 64, 65 in the driving circuit 63, to which the output of FF59 and the inverted reference pulse $\phi a$ are applied, are controlled by the output of FF59, as a result of which, signals having the period of two seconds and the same pulse width as that of the reference pulse $\phi a$ but being dephased by one second are obtained from NOR gates 64 and 65. P-MOS68, N-MOS69, P-MOS70 and N-MOS71 are controlled to switch on and off by the output from NOR gates 64 and 65, pulses which alternatingly produce change in logic level are at the terminals 63*a* and 63*b* of the driving circuit 63, and alternate polarity driving pulses are applied to the coil 72. Since a current which alternates in direction every one second and flows through the coil 72 in response to the driving pulses, the rotor of the stepping motor rotates in the predetermined direction.

Next, the operation will be described at the time when the reset operation is made. As mentioned above, when the reset operation is made by operating the control pin 36, the second pointer 18 moves to the predetermined indicating position and stops at that position. At the same time, the switch 50 is closed and the frequency dividing circuit 47 and the F.F52 are reset.

Figure 9:
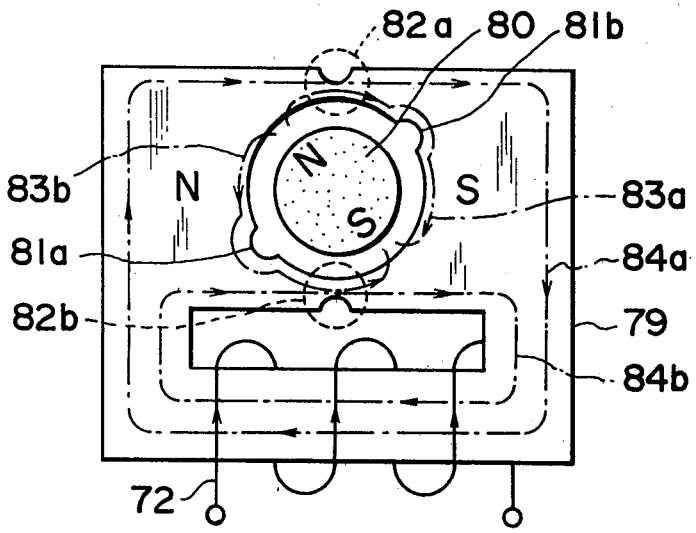
Figure 10:
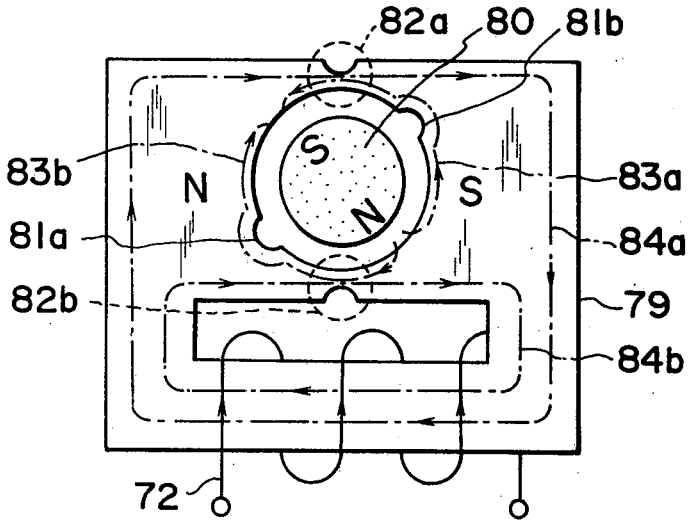

After resetting, when the frequency dividing circuit 47 reset condition is released by returning the control pin 36 to the original position, at first, the detecting signal $\phi b$ is applied to NOR gates 60 and 61 through NAND gate 54. NOR gates 60 and 61 permits the detection pulse $\phi b$ to pass selectively corresponding to the output of the FF59. For example, when the $\overline{Q}$ output of the FF59 is at the "0" level and the Q output is at the "1" level, the detection pulse $\phi b$ pass through the NOR gate 60, and the output of NOR gate 61 is maintained at the "0" level. Since the output of inverter 62 is at the "1" level, the outputs of NOR gates 64 and 65 in the driving circuit 63 remain at the "0" level. Therefore, in the driving circuit 63, P-MOS68, N-MOS69 and N-MOS71 remain in the off condition and P-MOS70 remains in the on condition, N-MOS75 in the detecting circuit 73 remains the off condition, and N-MOS74 in the detecting circuit 73 is turned on in response to the detecting pulse $\phi b$. As a result of which, the loop composed of P-MOS70, coil 72, N-MOS74 and resistor 76 is formed connected to the power supply so that the current flows through the coil 72. However, since the pulse width of detecting pulse $\phi b$ is narrow, the rotor of the stepping motor will not rotate. The direction of current flowing through the coil 72 for rotating the rotor in the forward direction is different from that for rotating the rotor in the reverse direction as described hereinafter. The rotor position is detected on the basis of the difference between the currents by the detecting circuit 73. The stepping motor in the embodiment shown in FIGS. 5 and 6 has six poles, however, for easy understanding, the operation principle of the stepping motor will be described referring to FIGS. 9 and 10 shown the stepping motor having two poles.

A stator 79 coupled magnetically to a magnet core (not shown) wound by coil 72, comprises notches 81*a* and 81*b* so as to decide the rotating direction of the rotor 80 which is magnetized in the radial direction with two poles, and saturable magnetic portions 82*a* and 82*b* are formed in the stator. When the current is not applied to the coil 72, the rotor 80 is stationed at the position where the angle between the notches 81*a*, 81*b* and the magnetic pole of the rotor is approximately 90°. When the current is flowing through the coil 72, the magnetic resistance of the magnetic circuit viewed from the coil 72 is very low before the saturable portions 82*a* and 82*b* of the stator 79 saturate and as a result, the time constant $\tau$ of the series circuit of resistor and coil becomes large. Therefore, the current wave characteristics include gradual rising. This can be expressed in the following equation.

$$\tau = L/R,\ L \approx N^2/R_m$$

Therefore, $\tau = N^2/(R \times R_m)$
where,
L; the inductance of the coil 2,
N; number of turns of the coil 2,
$R_m$; magnetic resistance.

When the saturable portions 82*a* and 82*b* of the stator 79 saturate, the permeability of the portions saturated are the same as that of the air, so that the magnetic resistance $R_m$ increases and the time constant $\tau$ of the circuit becomes small, as a result, the current shape suddenly rises. The detection of the rotor position of the electronic watch according to the present invention is made by utilizing the difference of the time constant of the series circuit of the resistor and the coil depending on the rotor position. Now, the reason for yielding the difference of the time constant will be explained.

FIG. 9 shows a condition of the magnetic field when the current begins to flow through the coil 72, wherein, the magnetic poles of the rotor 80 are positioned in the rotatable position. Reference numerals 83*a* and 83*b* show how the magnetic fluxes are produced from the rotor 80. In practice, although there exists a flux crossing the coil 72, this is omitted from the drawings. When the cutrrent flows through the coil 72 in the direction of arrow so as to rotate the rotor clockwise, the magnetic fluxes 84*a* and 84*b* produced by the coil 72 are strengthed by the fluxes 83*a* and 83*b* produced by the rotor 80 at the saturable portions 82*a* and 82*b* of stator 79, so that the stator will promptly saturate. Afterwards, the magnetic flux which has a sufficient strength for rotating the rotor 80 is produced in the stator 79, however, this is omitted from the drawing in FIG. 9. The current waveform flowing through the coil 72 at this time is shown as numeral 85 in FIG. 11.

Figure 11:
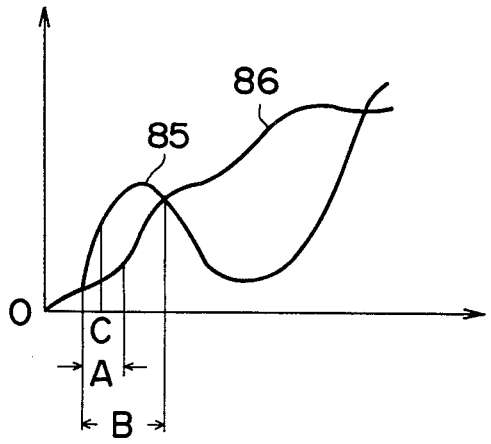
FIG. 11 shows a current waveform flowing through the coil of the stepping motor.

Next, the state of the stepping motor shown in FIG. 10 will be explained, wherein, the rotor is opposite the current direction shown in FIG. 9, so that the rotor 80 could not be rotated. Since the magnetic fluxes produced by the rotor 80 and the coil 72 cancel each other at the saturable portions 82*a* and 82*b* of the stator 79, to saturate the saturable portions 82*a* and 82*b*, a much greater time is necessary. The waveform 86 shown in FIG. 11 represents the waveform of current flowing through the coil 72 in this case. In FIG. 11, "A" indicates the time difference to the time when the saturable portions 82*a* and 82*b* of the stator 79 saturate. From the two current waveform 85 and 86 in FIG. 11, it is clear that the inductance of the coil 72 is large when the rotor 80 is rotating, and the inductance is small when the rotor 80 is not rotating within the time interval B. The point C in FIG. 11 is the time of 0.5 [msec] corresponding to the pulse width of the detecting pulse $\phi b$ and the change of current flowing through the coil 72 detected on the basis of the detecting pulse $\phi b$ terminates at the point C.

Figure 12:
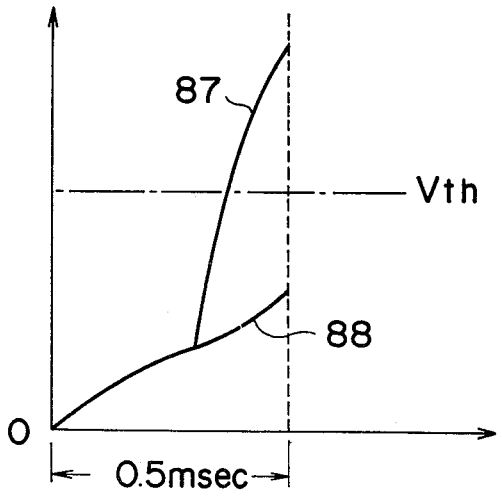
FIG. 12 shows a waveform chart of the voltage across the resistor in the detecting circuit.

FIG. 12 shows the change of the voltage across the resistor 76 which is produced by changing of the current flowing through the coil 72 as shown the waveforms 85 and 86 in FIG. 11. Numeral 87 indicates the voltage waveform when the rotor 80 is positioned in the rotatable position, and numeral 88 indicates the voltage waveform when the rotor 80 is positioned in the unrotatable position. In FIG. 12, $V_{th}$ represents the threshold of the inverter 77 which acts as the binary logic circuit in the detecting circuit 73.

When the current passes through the coil 72 in such a direction that the rotor 80 can be rotated, the divided voltage of the power source, that is, the voltage produced across the resistor 76 becomes higher than the threshold voltage $V_{th}$ of the inverter 77 as understood from FIG. 12, and the output of the inverter 77 becomes "0" level. On the other hand, when the current flows through the coil 72 in such a direction that the rotor 80 can be rotated, it is understood from the waveform 88 that the voltage produced across the resistor 76 is not increased more than the threshold voltage of the inverter 77 and the output of the inverter 77 is kept at the "1" level.

From the foregoing description, it is apparent that the detecting signal of the detecting circuit 73 produced from inverter 78 becomes "1" level when the rotor 80 is located in the rotatable position relative to the direction of the current flowing through the coil 72, and the detecting signal becomes "0" level when the rotor 80 is located in the unrotatable position. When the detecting signal of "1" level is applied to the clock terminal CL of D-FF56 in the control circuit 53, since the input of the data terminal D is at the "1" level at the rising time, the Q output of D-FF56 becomes "0" level at the time of falling. In the meantime, when the detecting signal is at the "0" level, the Q output of D-FF56 continues to be at the "1" level. After generation of the detecting pulse $\phi b$ the reversing pulse $\phi c$ is produced, and at this time if the $\overline{Q}$ output of the D-FF56 is at the "0" level, the reversing pulse $\phi c$ is cut by the NAND gate 57 and the clock signal and is not applied to the FF59 which acts as a converting circuit for converting the direction of the current flowing through the coil 72. As a result, the logical condition of output of FF59 does not change. On the other hand, when the $\overline{Q}$ output of D-FF56 is at the "1" level, the reversing pulse $\phi c$ passes through AND gate 57, and is applied to the clock terminal CL of FF59 through NAND gate 58. As a result of which, FF59 changes in its output condition.

After producing the reversing pulse $\phi c$, when the frequency divider output $Q_{15}$ from the frequency divider circuit 47 is changed to the "1" level, FF52 and D-FF56 are reset, the function of the controlling circuit 53 is stopped until the next reset operation time of the frequency divider circuit 47, and at the same time the function of the detecting circuit 73 is stopped. When the detecting circuit 73 detects that the rotor 80 is located at the unrotatable position, and the output of FF59 does not respond to the reversing pulse $\phi c$, so that the output is not inverted, by the first shot of the reference pulse $\phi a$ which is produced after releasing the reset condition in the frequency dividing circuit 47, in the driving circuit 63, N-MOS69 becomes ON, P-MOS68 becomes OFF, P-MOS70 becomes ON and N-MOS71 becomes OFF. Therefore, the current flowing through the coil 72 is directed from the output terminal 63*b* of the driving circuit 63 to the output terminal 63*a*. The current direction is coincident with the direction of the current flowing through the coil 72 in response to the detecting pulse $\phi a$, and the rotor 80 rotates.

On the other hand, when the output of FF59 is inverted by the inverting pulse $\phi c$, in the driving circuit 63, N-MOS71 becomes ON, P-MOS 70 becomes OFF, P-MOS 68 becomes ON and N-MOS 69 becomes OFF, in response to the reference pulse $\phi a$, and the current which is directed from the output terminal 63*a* to the output terminal 63*b* flows through the coil 72. The direction of this current is opposite to the direction of the current which flows through the coil 72 in response to the detecting pulse $\phi a$, that is, the direction which can rotate the rotor 80, so that the rotor 80 will rotate. Therefore, the polarity of the driving pulse produced in response to the first of the reference pulse $\phi a$ after releasing the reset condition, is positively controlled to the polarity which will enable the rotor 80 to rotate, and it can be solved the problem, in which the display time, after releasing the reset condition, loses time corresponding to one shot of the reference pulse due to an error in operation of stepping motor.

Figure 13:
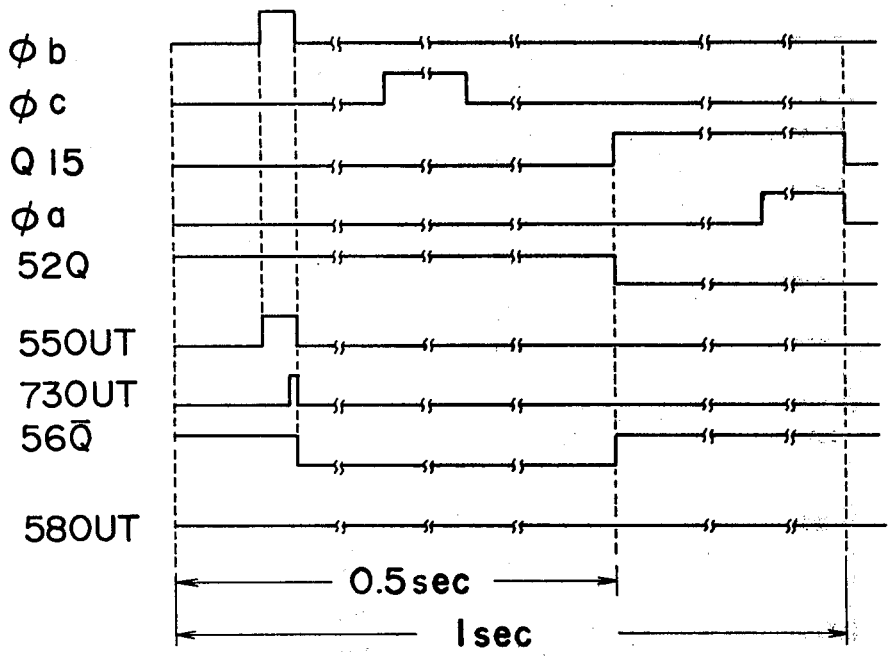
FIGS. 13 and 14 show time charts showing the output waveform of each of the portions in FIG. 7 at the time of detecting the rotor position.
Figure 14:
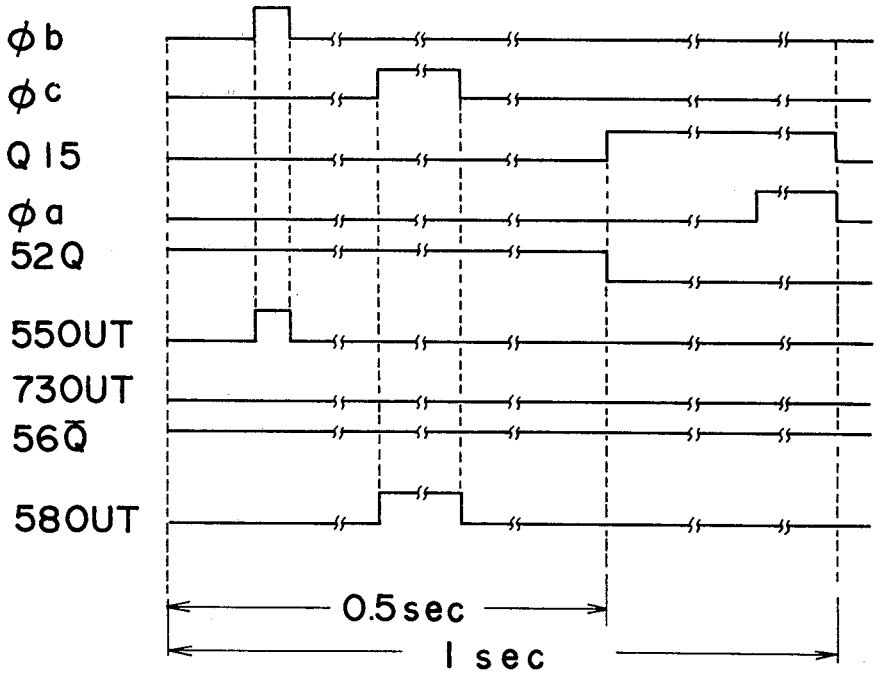

FIG. 13 shows the outputs of each of the portions in FIG. 7 when the rotor 80 is located at the rotatable position in response to the first shot of the reference pulse $\phi a$ after releasing the reset condition, and FIG. 14 shows the outputs of each of the portions in FIG. 7 when the rotor 80 is located at the unrotatable position in response to the first shot of the reference pulse $\phi a$ after releasing the reset condition. In FIGS. 13 and 14, 52Q is the Q output of the FF52, $FF_{out}$ is the output of the inverter 55 which is applied to the data terminal D of the D-FF56, $73_{out}$ is the detecting signal output signal of detecting circuit 73 which is delivered from inverter 78, $56\overline{Q}$ is the $\overline{Q}$ output of D-FF56, and $58_{out}$ is the output of NOR gate 58 which is applied to the clock terminal CL of FF59 for selecting the direction of the current flowing through coil 72.

The the operation of a stepping motor having two poles has been explained as an example hereinbefore, in the system wherein, the position of the rotor is detected, and the rotor rotates with certainty in response to the first reference pulse after releasing the reset condition, but the stepping motor having six poles can be also operated in the same way. In addition, in the embodiments shown in FIGS. 5 and 6, if the stepping motor having two poles is used, the ratio of the numbers of teeth among the rotor pinion 28, the second wheel 29 and the adjusting wheel 33 should be selected to be 2:40:60. From this selection, at the time of reset the second pointer 18 is moved to the dial positions of ten second, twenty second, thirty second, forty second, fifty second and zero second, and is stopped.

The above-described electronic watch according to the present invention is constructed in such a manner that the detecting pulse is applied to the coil of a stepping motor, and the rotor position is detected by the current characteristics or voltage signal of that, therefore, even when a ready-made or conventional stepping motor is used it is possible to detect the rotor position without any change to the construction of the ready-made stepping motor. Moreover, the elements which are necessary for detecting the difference of saturation time, depending on the rotor position, of a saturable magnetic path of the stepping motor of the integral stator type, are almost all switching elements using transistors and some resistors which can be incorporated into an integrated circuit. For this, all elements can be integrated within the integrated circuit, so that there is not factor of high cost. Furthermore, if circuit construction in which the resistance value can be selected by providing an intermediate terminal to the resistor which is used as the detecting element of the detecting circuit, and a pad on the integrated circuit, is formed, it will be possible to correct value errors of the resistor produced in the manufacturing process of the integrated circuit, and to apply the same integrated circuit to different stepping motors having different characteristics. In this embodiment according to the present invention, a resistor is used as the detecting element, however, a passive elements such as a coil and capacitor may be used as the detecting element, or a passive element, such as a MOS transistor, may be also used. Since the inverter comprised of C-MOS is used as the binary logic circuit in the detecting circuit, the threshold value $V_{th}$ is equal to a half of the source voltage, as a result of which, a detecting circuit which is not effected by the change of source voltage can be achieved.

Although the invention has been described on the basis of the embodiment of the electronic watch accoring to the present invention, it is understood that various changes and modifications may be made in the invention and that the invention is not limited to the embodiment in the drawings.

As mentioned above, since the electronic watch according to the present invention comprises an adjusting device which moves the second pointer to the predetermined time position and stops it at the reset time, it is easy to correct the time. Furthermore, the watch has a function in which the rotor position of the stepping motor is detected at the reset time, and the direction of current flowing through the coil is controlled so as to rotate the rotor in response to the first reference pulse after releasing the reset condition, so that the stepping motor can be exactly operated by the first shot of the reference pulse after releasing the reset condition. Therefore, it is possible to operate the stepping motor without any operating errors and to display the accurate time. As described in the foregoing, according to the present invention, the expected objects can be attained, and a striking effect can be obtained.

We claim:

1. An electronic timepiece, comprising: an oscillator circuit for generating an oscillatory time standard signal; a divider circuit receptive of the oscillatory time standard signal for generating a plurality of repetitive pulse output signals having different respective frequencies; pulse generating means receptive of the pulse output signals from said divider circuit for generating a detecting pulse signal, a reversing pulse signal and a reference pulse signal having predetermined relative timings determined by the pulse output signals from said divider circuit; a stepping motor having a rotor and a coil for receiving electrical driving pulses; a drive circuit responsive to a control signal for applying electrical driving pulses having polarities determined by the control signal for rotating said stepping motor rotor; control circuit means responsive to output pulses from said pulse generating means and having a normal operating mode for applying to said drive circuit the control signal effective to control said drive circuit to apply alternate polarity electrical drive pulse to said stepping motor coil to rotate said stepping motor rotor in a normal direction; mechanical display means driven by said stepping motor for displaying time, said mechanical display means including a time-indicating hand which changes position to indicate the value of a unit of time; reset circuit means including a manually operable switch for resetting said divider circuit to correct the time kept by the timepiece; means actuated by said manually operable switch for stopping said time-indicating hand at one of a plurality of spaced predetermined positions when said divider circuit is reset by said reset circuit means; and rotor position detecting means for detecting whether said stepping motor is in a position to rotate in response to a forthcoming electrical drive pulse after said divider circuit has been reset by said reset circuit means and for generating and applying an electrical signal to said control circuit means which indicates whether or not said stepping motor rotor is in a position to rotate, and said control circuit means being responsive to the electrical signal generated by said rotor position detecting means for applying a driving pulse having a polarity effective to rotate said stepping motor rotor after said divider circuit has been reset.

2. An electronic timepiece as claimed in claim 1, wherein said time-indicating hand of said mechanical display means is a seconds-indicating hand.

3. An electronic timepiece as claimed in claim 1, wherein said control circuit means applies the detection pulse signal to said stepping motor to test the rotor position, and wherein said rotor position detecting means is effective to detecting the rise in rotor coil current within a predetermined period of time in response to said detection pulse signal for determining whether said stepping motor rotor is in a position to be rotated.

4. An electronic timepiece as claimed in claim 1, 2 or 3, wherein said rotor position detecting means is comprised of a pair of switching elements each connected to a respective end portion of said stepping motor coil; means for applying the control signal from said control circuit means to render a respective one of said switching elements conductive; a circuit element connected to said switching elements for developing a voltage thereacross in response to the detection pulse signal applied to said stepping motor coil; and a threshold element exhibiting a threshold, receptive of the voltage developed across said circuit element, and developing an output signal when the voltage developed across said circuit element exceeds the threshold of said threshold element.

5. An electronic timepiece as claimed in claim 1, 2 or 3, wherein: said stepping motor includes a rotor pinion for driving said mechanical display means; and said means for stopping said time-indicating hand is comprised of a gear wheel engaged with said rotor pinion, a cam mounted for rotation with said gear wheel and having a plurality of equi-spaced lobes, and a lever positionable for engaging a pair of said cam lobes to prevent said gear wheel and said rotor pinion from rotating and for disengaging said cam lobes to permit said gear wheel and said rotor pinion to rotate, a portion of said lever being electrically conductive, and said manually operable switch of said reset circuit comprising said electrically conductive portion of said lever and a contact positioned for contacting said electrically conductive portion when said lever is positioned to engage said cam.

* * * * *